United States Patent [19]

Remington

[11] 4,395,891

[45] Aug. 2, 1983

[54] ZIPPER SLIDER LATCHING ASSEMBLY

[75] Inventor: Richard C. Remington, Pompton Plains, N.J.

[73] Assignee: Presto Lock, Inc., Garfield, N.J.

[21] Appl. No.: 195,415

[22] Filed: Oct. 9, 1980

[51] Int. Cl.[3] ..... E05B 67/38

[52] U.S. Cl. ..... 70/68

[58] Field of Search ..... 70/68, 64, 66, 67; 24/205 R, 205.15 H, 205.14 A, 205.11 R, 205.11 L, 205.14 K

[56] References Cited

U.S. PATENT DOCUMENTS

| | | | |
|---|---|---|---|
| 3,038,226 | 6/1962 | Kedzierski | 24/205.14 R |
| 3,133,328 | 5/1964 | Huelster | 24/205.14 R |
| 3,335,586 | 8/1967 | Levine et al. | 70/68 |
| 3,597,945 | 8/1971 | Feinberg | 70/74 |
| 3,858,283 | 1/1975 | Runnels | 24/205 |
| 3,952,379 | 4/1976 | Fukuroi | 24/205.14 R |
| 3,965,706 | 6/1976 | Davis | 70/68 |
| 4,015,457 | 4/1977 | Fukuroi | 70/68 |
| 4,069,555 | 1/1978 | Toepelt | 24/205 |
| 4,112,990 | 9/1978 | Anderson | 150/3 |

*Primary Examiner*—Robert L. Wolfe

*Attorney, Agent, or Firm*—Shapiro and Shapiro

[57] ABSTRACT

A zipper slider latching assembly includes a latch unit adapted to be mounted on and attached to a standard zipper slider by means of a snap fastener. The latch unit has spring-biased latching means engageable with a latch member received in the latch unit to fasten the latch member and the latch unit together, and has slider pull means mounted thereon for moving the slider and for controlling the latching means. When the slider pull means is in a rest position, the latching means is in a latching position. When the slider pull means is moved to a slider-moving position, the latching means is in a non-latching position. The latch unit also includes a locking mechanism for locking the slider pull means in its rest position. The latch member may be part of a hasp unit adapted to be mounted on a second zipper slider arranged with respect to the first zipper slider in a double-slider zipper arrangement.

19 Claims, 12 Drawing Figures

ZIPPER SLIDER LATCHING ASSEMBLY

BACKGROUND OF THE INVENTION

The invention relates generally to new and improved latching assemblies for a zipper slider, and more particularly to latching assemblies for a double-slider arrangement.

Zippers are commonly used as closures on soft-sided luggage cases and the like. Frequently, double-slider zippers are used which employ a pair of opposed sliders arranged to be brought together to close the zipper and moved apart to open the zipper. To prevent the inadvertent opening of the case, it is necessary to fasten the sliders together. It is also desirable to employ means for locking the sliders together to provide some measure of security for the contents of the case.

Small padlocks passed through holes in the pull tabs of the sliders have been used for holding (and locking) the zipper sliders together. However, this arrangement requires a separate part and has further drawbacks. Other approaches have employed a latching device, mounted on the luggage case, with which the sliders are brought into engagement. For example, the device may include an upstanding post sized to pass through holes in the slider pull tabs. When the sliders are brought together, the pull tabs are placed over the post. The sliders and post are then covered with a latching flap to prevent the pull tabs from slipping off. Tucktite style latches have also been used. Mounting of such latching devices is troublesome, and the devices are generally bulky. Moreover, the devices may still permit the sliders to separate, leaving a gap in the zipper, which is undesirable.

Fukuroi, U.S. Pat. No. 4,015,457 of Apr. 5, 1977, discloses another approach. An interlockable slider assembly is employed in which a latching mechanism is incorporated within the body of a specially constructed slider, the body of which includes a socket for receiving a projecting tongue integrally formed on a second slider. A key-released bolt enters the socket to engage the projecting tongue when the sliders are brought together. This arrangement requires special sliders, which are bulky, and requires a key to unlatch the sliders, which is inconvenient when locking is not desired.

SUMMARY OF THE INVENTION

It is an object of the invention to provide a new and improved latching assembly that overcomes the disadvantages of the prior art.

An additional object is to provide an improved latching assembly which will fasten the sliders of a double-slider zipper together without a gap between them.

A further object is to provide an improved latching assembly which incorporates a separate locking mechanism for locking the sliders in a latched relationship.

A still further object is to provide a latching assembly which has a simple, inexpensive construction, is easily attached to conventional zipper sliders, and is convenient to use.

Yet a further object is to provide a latching assembly having an aesthetically pleasing slim-line appearance.

Briefly stated, a zipper slider latching assembly in accordance with the invention includes a latch member, a latch unit adapted to be mounted on and attached to a zipper slider, the latch unit having means for receiving the latch member and having spring-biased latching means therein engageable with the latch member to fasten the latch member and the latch unit together, and slider pull means mounted on the latch unit for moving the slider and for controlling the latching means. The slider pull means has a rest position at which the latching means is in a latching position, and has a slider-moving position at which the latch means is in a non-latching position.

In accordance with another aspect of the invention, a latching assembly includes a spring member having a latch portion movable between latching and non-latching positions, movable actuating means engageable with the spring member for controlling the position of the latch portion, the latch portion being in the latching position when the actuating member is in a first position and being in the non-latching position when the actuating means is in a second position, and bolt means movable between a locking and a non-locking position. The spring member has a bolt-spring portion for holding the bolt means alternately in the locking and the non-locking positions. When in the locking position, the bolt means engages the actuating means to prevent movement of the actuating means from the first position.

In accordance with yet another aspect of the invention, a snap fastener is provided for attaching an assembly to a lug of a zipper slider.

DESCRIPTION OF THE PREFERRED EMBODIMENTS

Figure 2:
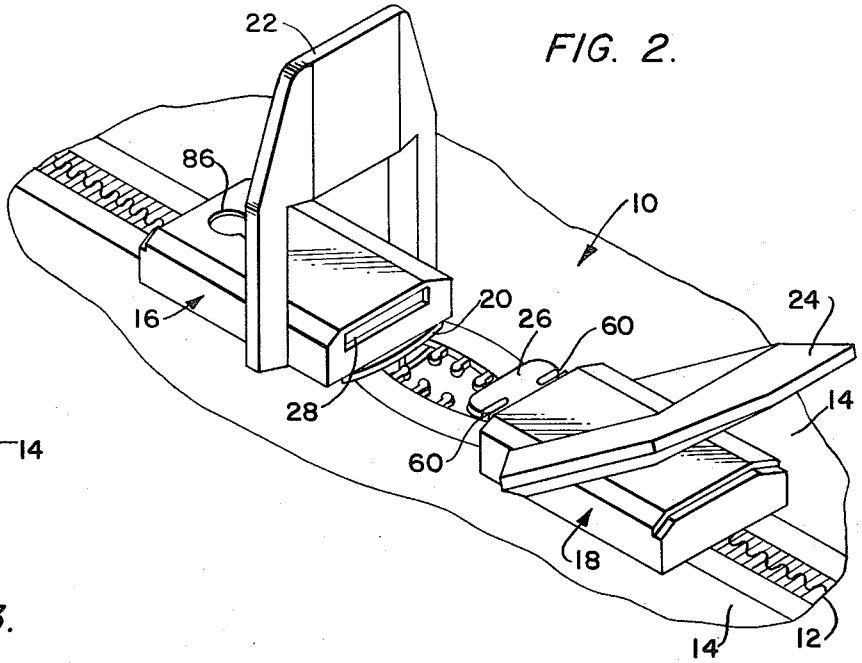
FIG. 2 is a perspective view illustrating the latching assembly of FIG. 1 in an unlatched position.

Although the invention has diverse applications, it is particularly well suited for use with a luggage case having a double-slider zipper or slide fastener as the closure for the case, and it will be described in that environment for illustative purposes. Conventionally, two types of double-slider zipper arrangements may be employed as luggage case closures, and the invention is applicable to both. The first type employs a single continuous slide fastener with fastener elements or scoops of the double-acting type. The second type employs two slider fasteners with single-acting fastener elements, the zippers being arranged with their top stop ends adjacent to one another so that the sliders can be brought together when the zippers are closed. For illustrative purposes, a latching assembly 10 in accordance with a first embodiment of the invention (FIGS. 1–7) and a latching assembly 200 in accordance with a second embodiment of the invention (FIGS. 8–12) are shown in the drawings employed with a zipper arrangement of the first type, having a single zipper 12, 212. Opposite sides of the zipper are attached to opposed parts 14, 214 of a soft-sided luggage case, for example.

Figure 1:
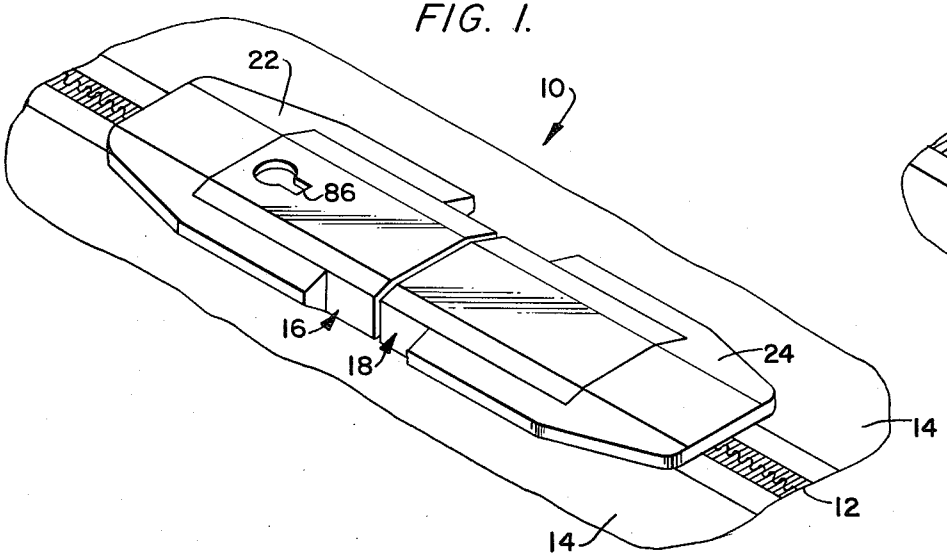
FIG. 1 is a perspective view of a first embodiment of a latching assembly of the invention employed with a double-slider zipper, this view illustrating the latching assembly in a latched position.

Latching assembly 10 preferably comprises a latch unit 16 and a hasp unit 18 formed to be mounted upon sliders 20 (FIG. 4) of the zipper 12, in a manner to be described later. Generally U-shaped slider pulls or loops 22, 24 are pivotally mounted on the latch unit and hasp unit, respectively. As will be explained hereinafter, the loops are biased by springs toward a non-operating or rest position in which they lie in the same planes as the latch and hasp units and are flush therewith, as shown in FIG. 1, for example. The loops may be lifted to an operating position (FIG. 2) in which they function as conventional slider pull tabs to permit the sliders to be moved along the zipper stringers.

A hasp or latch member 26 projecting from one end of the hasp unit 18 is received in an opening 28 of the latch unit when the hasp unit and latch unit are brought together in the closed condition of the zipper. As will be described in detail hereinafter, latch unit 16 incorporates a novel latching mechanism for engaging hasp 26 to fasten the latch unit and hasp unit together. As used herein, the term "hasp" means a member capable of being engaged by the latching mechanism to fasten the units together. The latching mechanism of the latch unit is actuated by loop 22 when the loop is returned from its lifted or operating position to its non-operating position. To unlatch the sliders, it is simply necessary to lift loop 22 of the latch unit and move the sliders apart.

It is an important advantage of latching assembly 10 that the manner of effecting latching engagement between the latch unit and the hasp unit is an actual carry through of the closing movement of the sliders themselves along the zipper track. This is a movement in the plane of the zipper and does not require any downward force against the sides 14 of the soft-sided case to effect engagement. In closed condition (FIG. 1), the sliders are held together in abutting relationship and there is no visible gap in the zipper. Moreover, loops 22 and 24 are flush with the latch and hasp units, respectively, imparting a pleasing slim-line appearance to the latching assembly.

Figure 3:
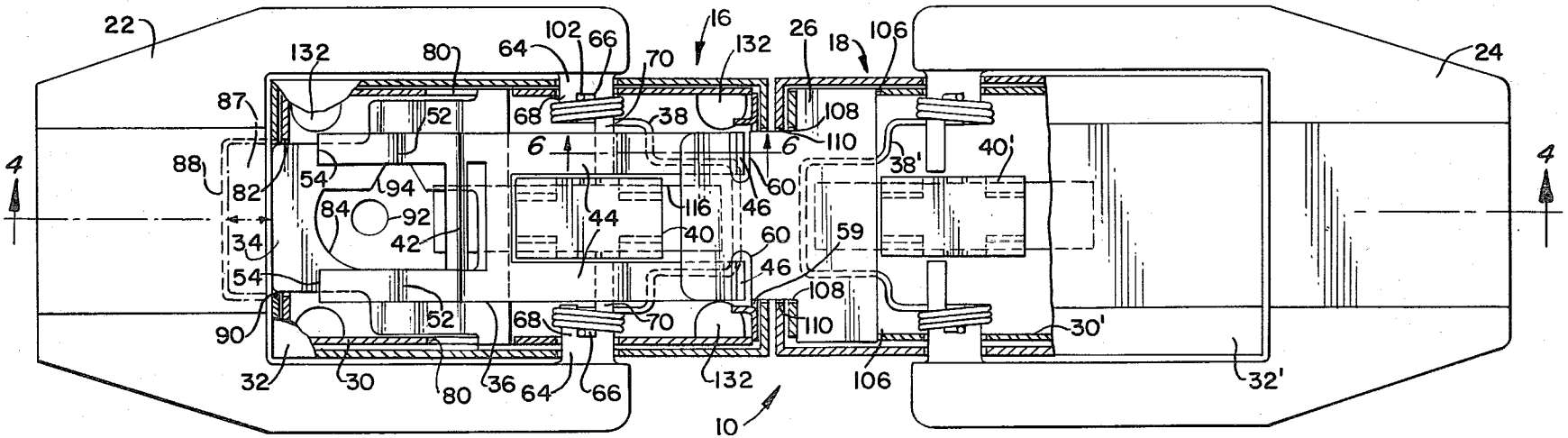
FIG. 3 is a top plan view, partially broken away, of the latching assembly of FIG. 1.
Figure 4:
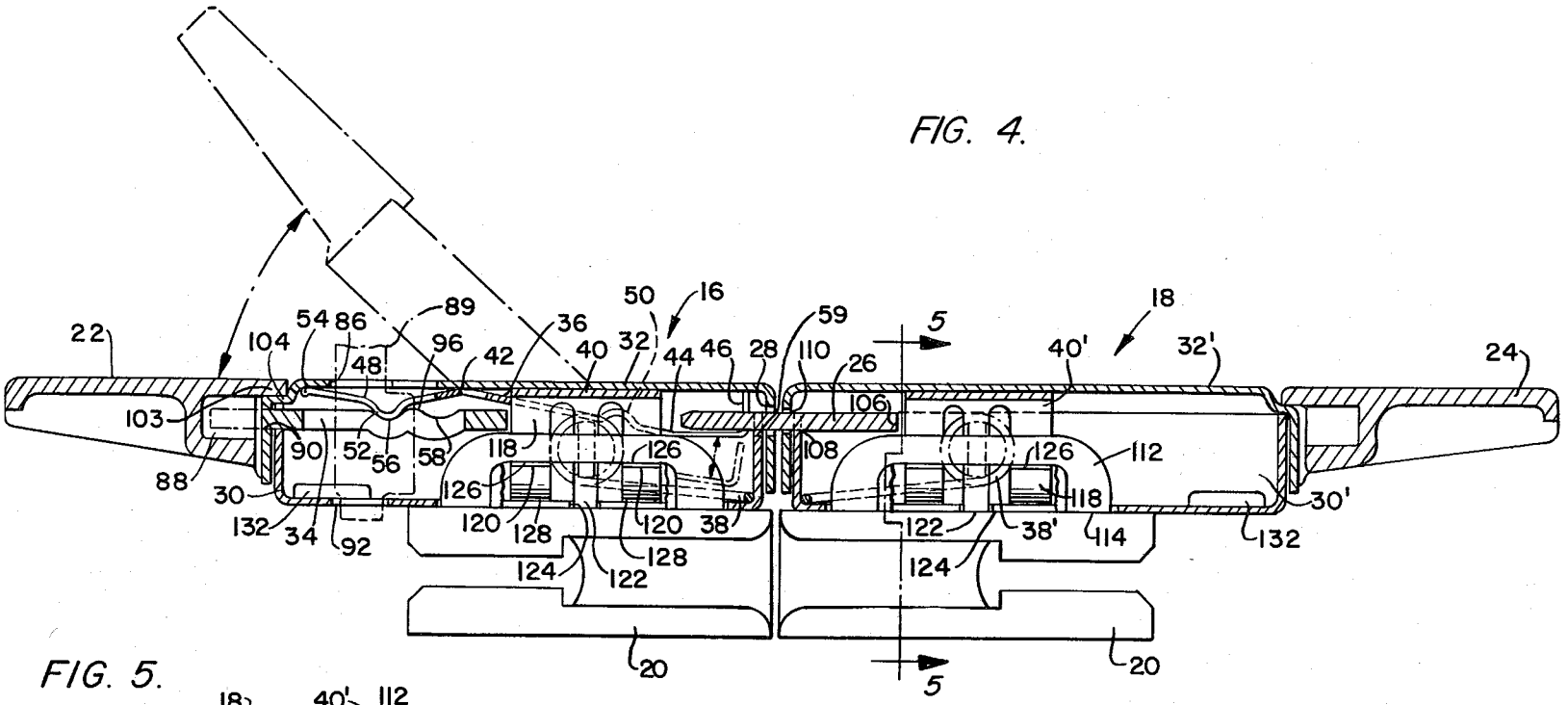
FIG. 4 is a vertical sectional view taken along line 4—4 of FIG. 3, partially broken away, and illustrating the latching assembly mounted on the sliders of a zipper.
Figure 5:
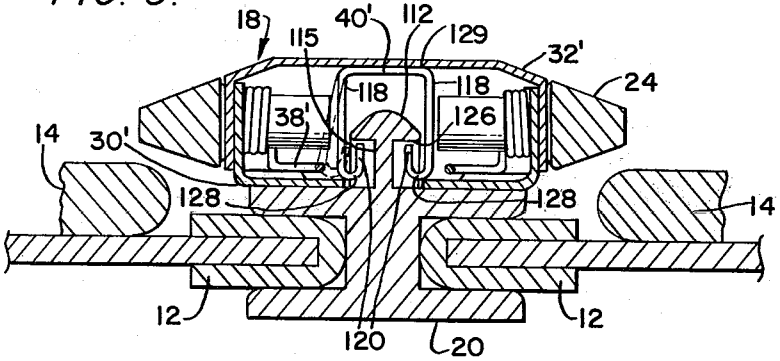
FIG. 5 is a vertical sectional view taken along line 5—5 of FIG. 4 and illustrating additional parts of the zipper.

The latching and the locking mechanisms of latching assembly 10 will now be described in detail with particular reference to FIG. 7. The latch unit 16 includes a frame or base 30 and a cover plate 32, which may be generally rectangular as illustrated. (Hasp unit 18 includes a similar frame 30' and a cover plate 32' as shown in FIGS. 3–5.) Within the latch unit, there is a bolt 34 comprising part of the locking mechanism, a bolt spring 36 comprising part of both the latching mechanism and the locking mechanism, a loop spring 38 for biasing loop 22 toward a non-operating position, and a clip 40 for attaching the latch unit to a slider.

Bolt spring 35 is a dual function element. It serves both as a latch for engaging hasp 26 of the hasp unit and as a spring for the bolt 34. The bolt spring is preferably a leaf-type spring formed from flat spring steel or other suitable resilient material, and preferably it is generally H-shaped as illustrated. Extending somewhat downwardly (in FIG. 7) from a central section or cross member 42 of the bolt spring are a pair of long legs 44 having upturned ends 46. A pair of short legs 48 extend from central section 42 in the opposite direction. Between the central section 42 and the upturned ends 46, the long legs 44 are each formed with an upwardly arcuate section 50. A similar but downwardly arcuate section 52 is formed in each of the short legs 48 between central portion 42 and the ends 54 of the short legs. The long legs 44 of the bolt spring, including upturned ends 46 and arcuate sections 50, are part of the latching mechanism of the assembly, while the short legs 48 of the bolt spring cooperate with bolt 34 to provide a locking mechanism.

As shown in FIG. 4, bolt spring 36 is positioned within the latch unit 16 so that the portion between central section 42 and the ends 54 of the short legs is compressed between bolt 34 and cover plate 32. As shown, short legs 48 extend downwardly from central section 42 to arcuate sections 52, and then upwardly to their ends 54. Central section 42 and ends 54 of the short legs contact the underside of cover plate 32, while the arcuate sections 54 contact one of two depressions 56, 58 formed in bolt 34, so that the bolt spring is slightly compressed and held in place.

Figure 6:
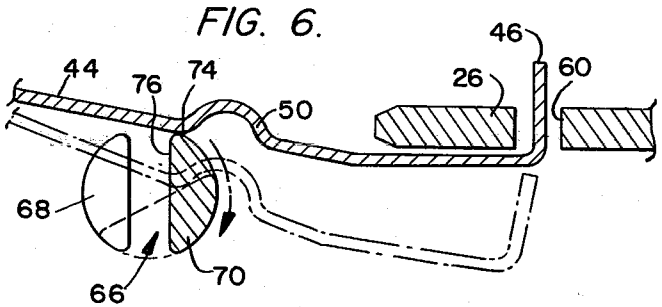
FIG. 6 is an enlarged fragmentary sectional view taken along line 6—6 of FIG. 3.

As also shown in FIG. 4, the long legs 44 of the bolt spring extend downwardly from the central secton 42 toward the end of the latch unit at which opening 28 in cover plate 32 and notch 59 in frame 30 (FIG. 7) receive the hasp 26. In a relaxed condition, the long legs of the spring are in the position indicated by the phantom lines in FIGS. 4 and 6. This is the unlatched position of the latching mechanism. When the long legs are raised upwardly to the position indicated by the solid lines in FIGS. 4 and 6, upturned ends 46 enter slots 60 formed on opposite sides of the portion of hasp 26 received within the latch unit (FIGS. 2, 3 and 6). This is the latched position of the latching mechanism.

Legs 44 of the bolt spring are moved from their non-latching position to their latching position by loop 22. As best illustrated in FIG. 7, a boss 64 extends inwardly from the end of each leg 62 of loop 22. Bosses 64 serve as trunnions which fit into cutouts 72 in frame 30 and cover plate 32 to pivotally mount loop 22 on the latch unit. Each boss 64 is preferably cylindrical and has a longitudinal, vertical slot 66 therein forming a pair of inward projections, a short projection 68 and a longer projection 70, shaped as shown in FIGS. 6 and 7. Projections 68, 70 are sized such that the longer projections extend beneath legs 44 of the bolt spring while the shorter projections clear the bolt spring (FIG. 3). Projections 70 have a curved surface portion 74 (FIG. 6) and a flat surface portion 76 which forms one side of slot 66.

When loop 22 is in the non-operating or rest position (FIGS. 1 and 4) each long leg 44 of the bolt spring is engaged by curved portion 74 of the corresponding long projection 70, as shown in FIG. 6, causing the upturned end 46 of the long leg to be raised to enter slot 60 of hasp 26. When loop 22 is lifted from its non-operating position to move the slider, projections 70 rotate clockwise, as shown by the arrow in FIG. 6. Legs 44 of the bolt spring, biased toward their rest position, move to that position as illustrated by the phantom lines in FIGS. 4 and 6, to unlatch the assembly. As the loop is returned to its non-operating position, the curved portions 74 of projections 70 act as a cam to lift legs 44 of the bolt spring to the latching position.

The upwardly arcuate sections 50 and flat portions 76 of projections 70 cooperate to allow legs 44 to move between a latching and a non-latching position with a relatively small rotation of loop 22. As can be seen in FIG. 6, in the latched position the curved portion 74 of each projection 70 engages the underside of the corresponding leg 44 adjacent to arcuate section 50. As projection 70 is rotated slightly clockwise, as when loop 22 is lifted from its non-operating position, the flat portion 76 of projection 70 slides into contact with arcuate section 50. This permits the bolt legs 44 to drop downwardly by a greater amount than if the bolt legs were straight and permits the assembly to be unlatched when loop 22 is lifted by a small amount, insuring positive latching and unlatching.

As previously mentioned, in addition to functioning as part of the latching mechanism, bolt spring 36 also cooperates with bolt 34 to provide a locking mechanism. As illustrated in FIGS. 3 and 7, bolt 34 may be slideably supported by notches 80 in the sides of frame 30 and notch 82 in the end of the frame. The bolt includes a cutout portion 84 shaped to cooperate with a key inserted through a key hole 86 in the cover plate to slide the bolt to the left and right in FIGS. 3 and 4. As the bolt slides leftwardly, its end 87 moves through an opening 90 in the cover plate and into a recess 88 formed in the base of loop 22 between legs 62.

In FIG. 4, the bolt is shown in an unlocked position (solid lines). In this position, arcuate sections 52 of the bolt spring engage depressions 56 in the bolt. To move the bolt into locked position (shown in phantom lines in FIGS. 3 and 4), a key 89 (shown fragmentarily in phantom in FIG. 4) may be inserted through keyhole 86 with its tip received in key tang hole 92 in frame 30. As the key is rotated, a tooth of the key engages abutment portion 94 (FIG. 7) of cutout 84, causing the bolt to slide to the left in FIGS. 3 and 4. As the bolt moves leftwardly, arcuate sections 52 of the bolt spring are moved upwardly by the ridge 96 between each pair of depressions 56, 58 of the bolt, the ridges acting as a cam. Arcuate sections 52 move into depressions 58 when the bolt enters recess 88 in the loop 22, to hold the bolt in the locked position.

When the end 87 of the bolt enters recess 88 of the loop, it prevents the loop from being lifted from its non-operating position. Accordingly, bolt spring legs 44 are prevented from moving to the non-latching position and the latching mechanism is held in a locked condition. Unlike the operation of a conventional bolt in which the bolt itself moves to engage a hasp or other member to prevent its release, the movement of the bolt 34 from the unlocked to the locked position is not in and of itself the latching action necessary for engagement between the latch unit and the hasp unit. The bolt functions as a safety latch to prevent movement of the loop required to unlatch the assembly.

Loop spring 38 of the latch unit biases loop 22 toward its non-operating position. As illustrated in FIG. 7, loop spring 38 may be generally U-shaped with its ends formed into coils 100 sized to fit over bosses 64. A portion 102 of each coil is straight, as shown in FIG. 7, and formed to enter slot 66 of the corresponding boss. Prior to assembly of loop 22 in the latch unit, the coils 100 of the loop spring may be placed around bosses 64 with the straight portions 102 of the coils positioned in slots 66, and the spring wound to tension it properly. The bias of the spring urges loop 22 counterclockwise in FIG. 4 so that an abutment 103 contacts a ledge portion 104 of the latch unit. This serves as a stop to hold the loop in the plane of the latch unit. Loop 22 may be lifted to an operating position against the tension of loop spring 38, disengaging the latching mechanism, as previously described, to permit the sliders to be moved. When the loop is released, loop spring 38 causes it to snap back to its non-operating position. This rotates projections 70 in a counterclockwise direction (FIG. 6) causing them to lift legs 44, as previously described, and to actuate the latching mechanism.

The construction of hasp unit 28 may be similar to that of the latch unit, except that there is no bolt or bolt spring and, hence, no keyhole in the cover plate 32' or key tang hole in the frame 30'. Hasp 26 is fixed within the hasp unit. The hasp may be held in notches 106, 108 in frame 30' (FIGS. 3 and 4), and may extend through an opening 110 in the hasp unit cover plate. Loop 24 may be identical to loop 22, if desired, since this minimizes the number of different parts required and reduces costs. Loop 24 preferably is also biased toward a non-operating position with a loop spring 38', which may be identical to loop spring 38. This eliminates any jiggling of loop 24 and imparts a "feel" to loop 24 similar to that of loop 22.

Prior to describing the assembly of the parts shown in FIG. 7, the novel arrangement of the invention for attaching the latch and hasp units to their zipper sliders will be explained.

As shown in FIGS. 4 and 5, standard sliders 20 are typically formed with a generally U-shaped lug 112 integral with top wing 114 of the slider body for attaching a pull tab thereto. (Pull tabs are not needed on the sliders 20 since loops 22, 24 serve this function.) Lug 112 may be either an open-web lug such as a loop having an open central portion or a closed-web lug (see the hasp unit in FIG. 5, for example, illustrating a lug 112 in which the central portion 115 is closed). The attachment of the latch unit to its slider will now be described, the attachment of the hasp unit to its slider being accomplished in a similar manner.

Figure 7:
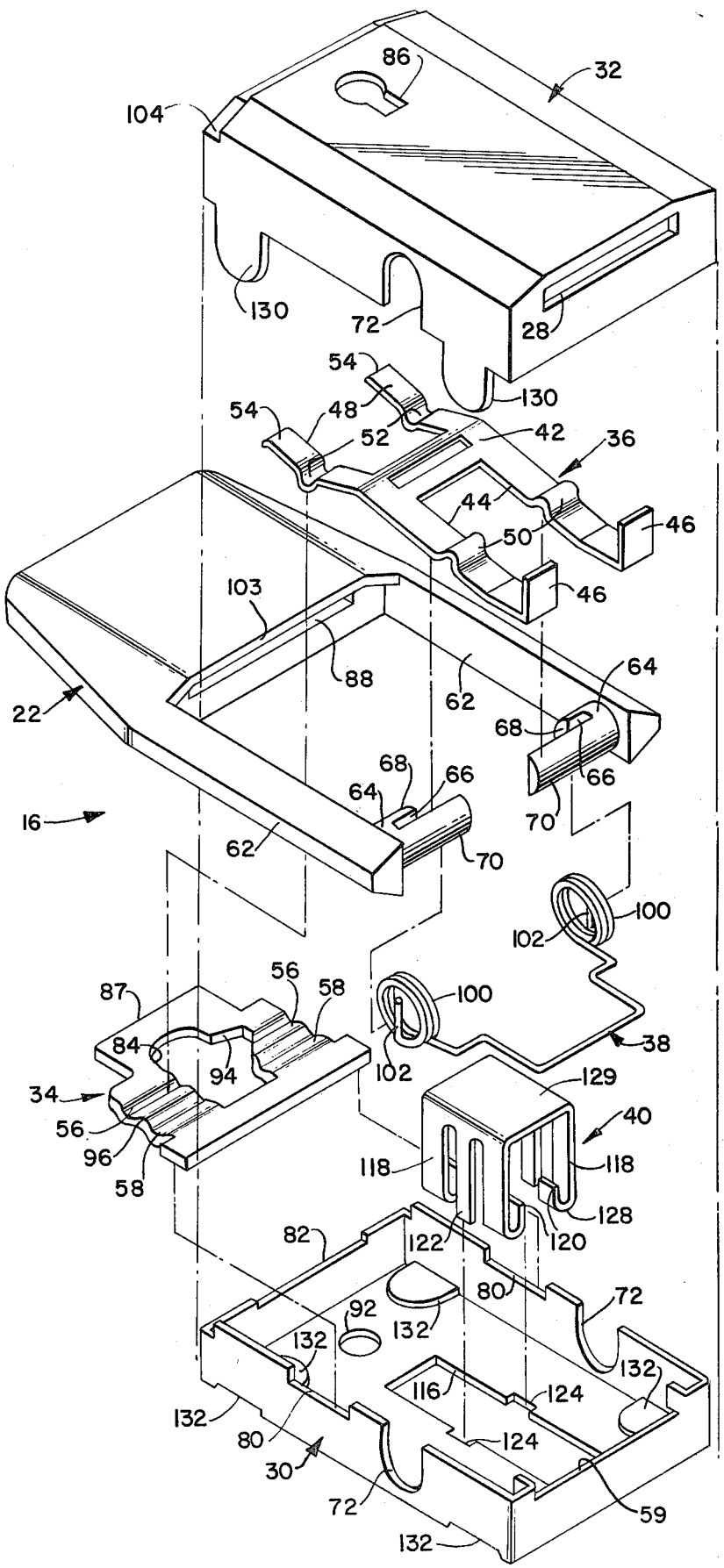
FIG. 7 is an exploded perspective view of a latch unit in accordance with the invention.
Figure 8:
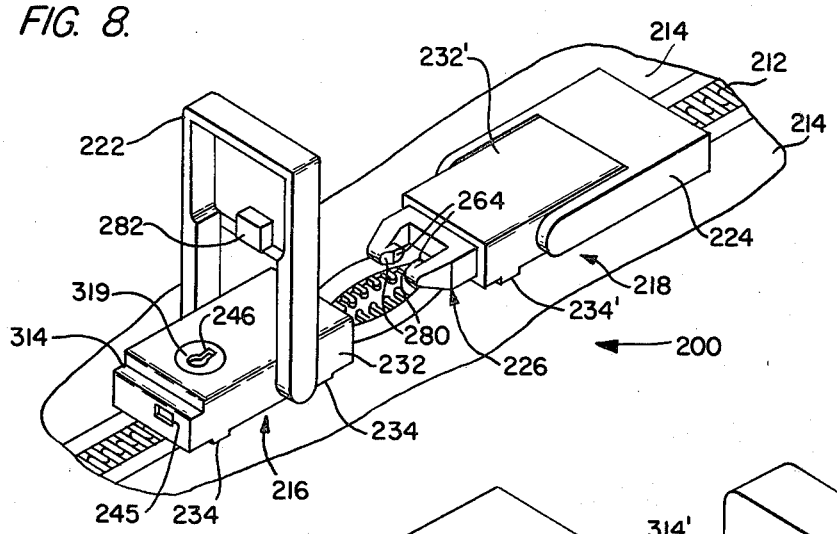
FIG. 8 is a perspective view similar to FIG. 2 illustrating a second embodiment of a latching assembly of the invention.

An elongated hole 116, which may be generally rectangular as illustrated in FIG. 7, is formed in the base of frame 30. Hole 116 is sized to admit the U-shaped lug 112 of a slider. When the latch unit is mounted upon the slider, U-shaped lug 112 extends into the unit and is engaged by a clip 40 to attach the unit to the slider. Clip 40 is preferably generally U-shaped and formed from spring steel or other suitable resilient material. Each side of the clip is preferably trifurcated to provide three legs. The outer legs 118 on each side of the clip have their ends 120 curled under so that these legs are substantially J-shaped. The center leg 122 on each side of the clip is straight, extends downwardly slightly more than legs 118, and is received in notch 124 formed in a long side of hole 116. The engagement between the center legs 122 and notches 124 serves to hold the clip in position within the latch unit. When the unit is in place on the slider body, the curled under ends 120 are trapped beneath shoulders 126 of U-shaped lug 112 (see FIG. 5, which shows the attachment of the hasp unit to its slider by means of a clip 40' like clip 40). The lower portion 128 of each curled under end 120 abuts the bottom of frame 30, while the top 129 of the clip abuts cover plate 32.

To attach the latch unit to the slider, the U-shaped lug 112 of the slider is aligned with elongated hole 116. The unit is then pushed onto the slider over the U-shaped lug. As the U-shaped lug enters the unit, legs 118 of the clip are cammed outwardly by lug 112, as indicated by the phantom lines in FIG. 5. When the lug has entered the unit sufficiently to permit ends 120 to be received beneath shoulders 126, legs 118 snap back into position, with their ends 120 trapped beneath shoulders 126. Accordingly, clip 40 (and clip 40' of the hasp unit) serves as a snap fastener to enable the latch unit to be "snapped" onto its slider. As previously mentioned, the hasp unit may be attached to its slider in the same manner.

This method of attaching the latch and hasp units to the sliders has been found to be very convenient and effective, and the resulting operation of the sliders is very smooth. The loops, which may be restyled to have other sizes and shapes, (see, for example, the second embodiment illustrated in FIGS. 8–12) serve as relatively large pull tabs and promote ease of zipper operation. As will be appreciated by those skilled in the art, the simplicity of the attaching mechanism and the relative ease with which the units may be reattached to the sliders are significant advantages. Standard sliders may be employed with the latching assembly of the invention without modification (except for the deletion of the standard pull tabs) and without the necessity for extra parts to attach the latching assembly to the sliders. Moreover, as is apparent from the foregoing description, there is very little internal movement of the components that make up the assembly. Accordingly, the possibility of a malfunction is reduced.

The clips, the bolt spring and the loop springs may be formed from spring steel or other suitable resilient material as already noted. The remaining parts of the latch assembly may be formed from any suitable materials using well-known techniques. The similarities between the latch and hasp units and the use of identical or similar parts minimizes tooling.

To assemble the latch unit, the loop spring 38 first may be assembled with bosses 64 of loop 22, as previously described, and the assembled parts placed in the cover plate 32. Clip 40 is next placed in the cover plate, and bolt 34 and bolt spring 36 are positioned in frame 30. The frame and cover plate may then be brought together. Preferably, the cover plate is formed with a plurality of closing lugs 130 (two such lugs extending from one side being illustrated in FIG. 7) which may be bent around the bottom of the frame and received into corresponding indentations or recesses 132 to attach the cover plate to the frame, completing the assembly. Recesses 132 permit lugs 130 to be flush with the bottom of the frame.

Assembly of the hasp unit is similar except that the hasp 26 and clip 40' are positioned in frame 30' rather than in the cover plate 32'. The frame and cover plate may then be brought together with the hasp projecting through slot 110 in the cover plate. Cover plate 32' and frame 30' may be held together with closing lugs in the same manner as the latch unit.

FIGS. 8–12 illustrate a second embodiment of a latching assembly 200 in accordance with the invention. Latching assembly 200, which is the preferred form of the invention, has a construction which in many respects is similar to the first embodiment. Latching assembly 200 provides the same advantages previously described in connection with the first embodiment of the invention and, in addition, provides other advantages which will become apparent from the following description. Because of the similarities between the two embodiments, the following description will focus primarily on the features of the second embodiment which differ from those of the first embodiment.

As shown in FIGS. 8–12, latching assembly 200 generally comprises a latch unit 216 and a hasp unit 218 formed to be mounted upon and attached to the sliders 220 (FIG. 12) of zipper 212, in a manner to be described later. U-shaped slider pulls or loops 222, 224 are pivotally mounted on the latch unit and the hasp unit, respectively. As in the first embodiment, each loop is biased toward a rest position in which it lies in the same plane as its corresponding unit and is flush therewith. The loops function as slider pulls and may be lifted to a slider-moving position to permit the sliders to be moved along the zipper stringers. As will be explained in detail hereinafter, the latch unit incorporates a novel latching mechanism, which is somewhat different from that described for the first embodiment, for engaging a hasp or latch member 226 which projects from one end of the hasp unit and which is received in an opening 228 (FIGS. 11 and 12) of the latch unit when the hasp unit and the latch unit are brought together in the closed condition of the zipper. As with the first embodiment, the latching mechanism is controlled by the latch unit loop. To unlatch the sliders, loop 222 may be lifted to the slider-moving position to disengage the latching mechanism from hasp 226, and the sliders may be moved apart. As will also be described hereinafter, the latching mechanism construction is such that it allows the sliders to be latched together without the necessity of operating loop 222. A locking mechanism for locking the sliders together in latched condition is also included.

Figure 9:
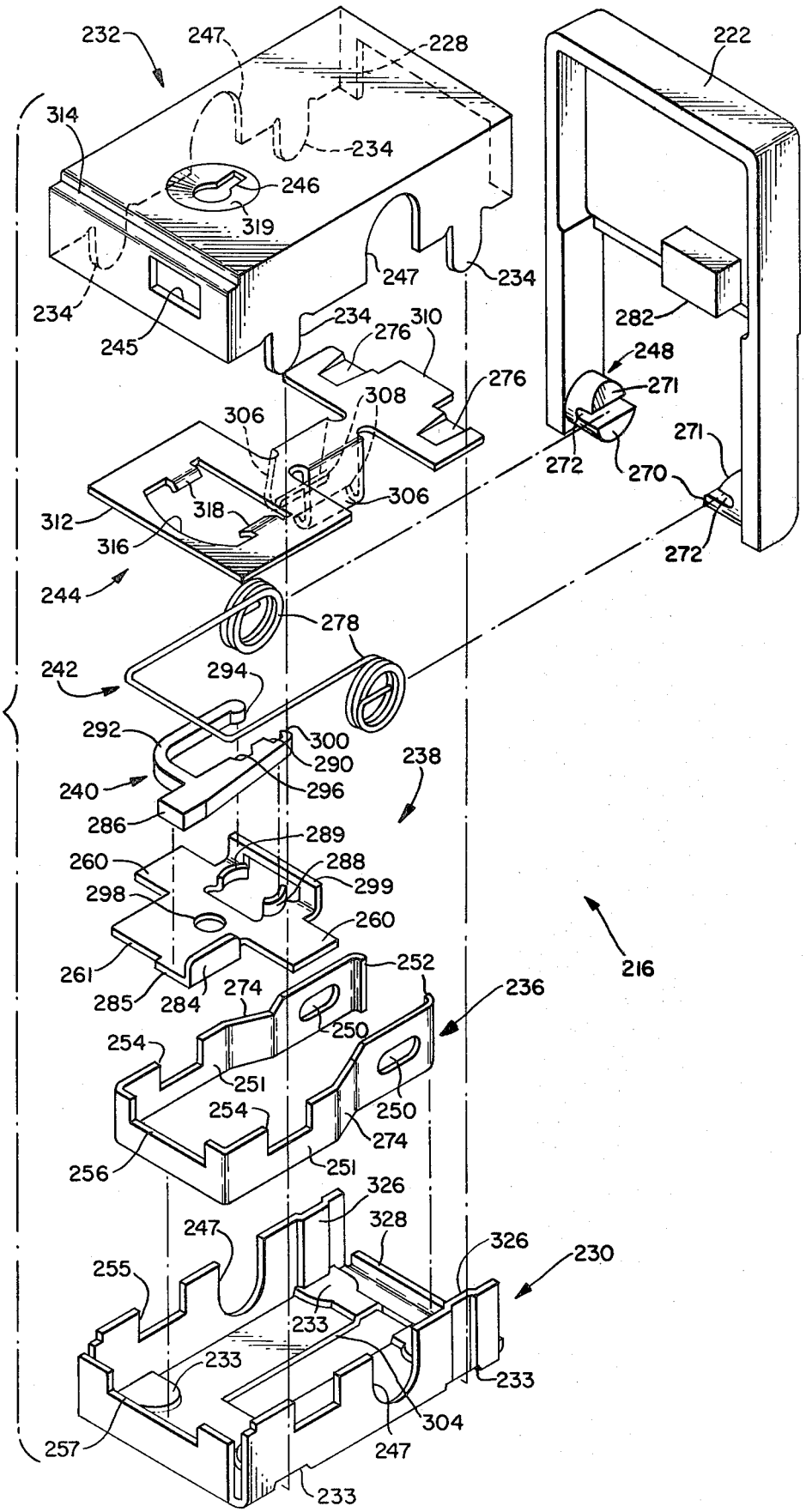

As shown in FIG. 9, latch unit 216 includes a frame or base 230 and a cover plate 232, which are preferably stamped steel members having a generally rectangular shape as illustrated in the figure. As in the first embodiment, frame 230 is sized to fit within the cover plate 232 and may have recesses 233 in its underside for receiving closing tabs 234 of the cover plate for attaching the cover plate and the frame together. The latch unit also includes a plug spring 236, which forms part of the latching mechanism of the assembly, a spacer plate 238 slideably supporting a bolt 240 which forms part of the locking mechanism, a loop spring 242 for biasing loop 222 to a rest position and a clip 244 for attaching the latch unit to a zipper slider.

Figure 10:
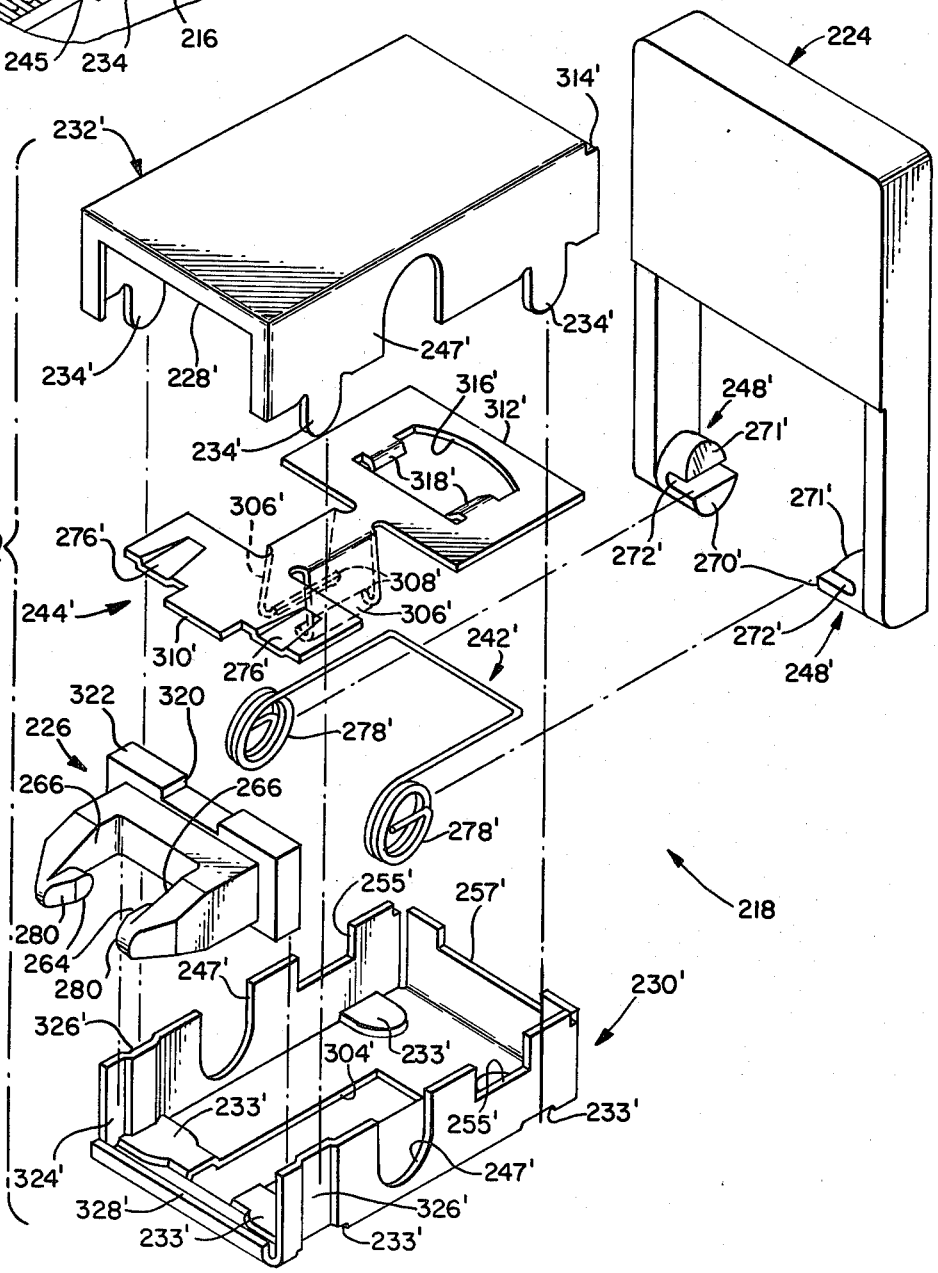
FIGS. 9 and 10 are similar enlarged exploded perspective views of a latch unit and a hasp unit, respectively, of the latching assembly of FIG. 8.

As shown in FIG. 10, hasp unit 218 may similarly include a frame or base member 230' which is preferably identical to frame 230 of the latch unit, and a cover plate 232' which may be similar to cover plate 232 of the latch unit. Frame 230' and cover plate 232' may be connected together in the same manner as the frame and cover plate of the latch unit by closing lugs 234' received in recesses 233' in the frame. The hasp unit also includes a loop spring 242' and a clip 244', which may be identical to corresponding parts in the latch unit, and includes hasp 226 projecting from one end of the unit, as previously mentioned.

Figure 11:
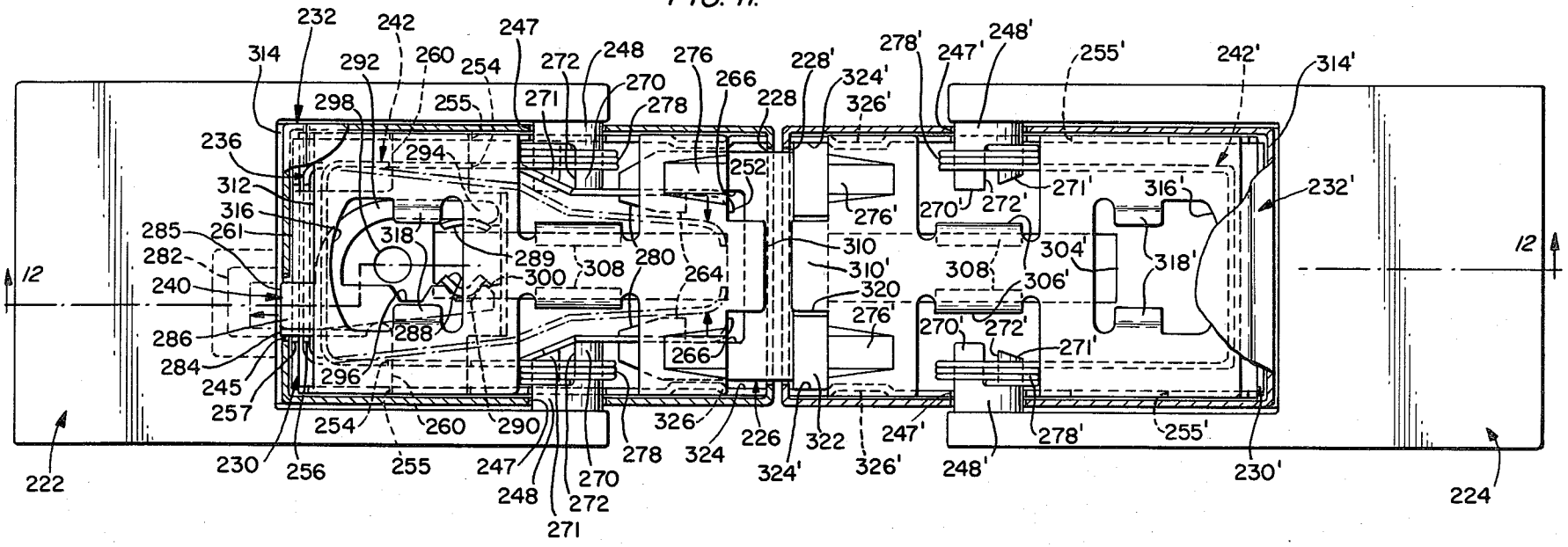
FIG. 11 is a top plan view, partially broken away, of the latching assembly of FIG. 8, this view illustrating the latching assembly in latched position.
Figure 12:
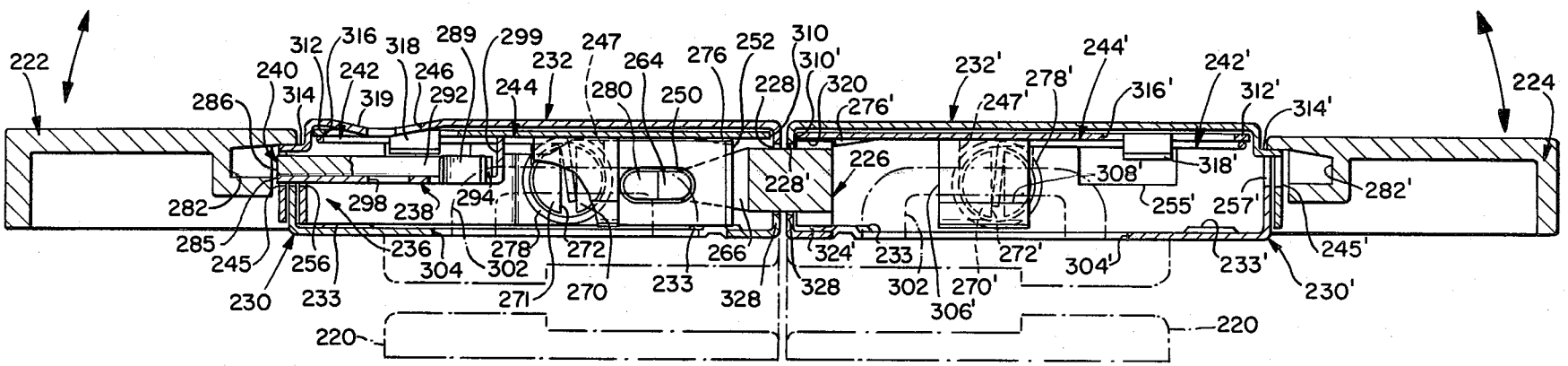
FIG. 12 is a vertical sectional view taken along line 12—12 of FIG. 11 and illustrating the latching assembly mounted on the sliders (shown in phantom lines) of a zipper.

As shown in FIG. 9, one end of frame 230 of the latch unit is open and the corresponding end of the cover plate 232 has a generally rectangular cutout which forms opening 228 in the end of the latch unit for receiving hasp 226. Similarly, one end of frame 230' in the hasp unit is open and cover plate 232' of the hasp unit has a rectangular cutout which forms an opening 228' through which hasp 226 projects, as shown in FIGS. 10–12. Latch unit cover plate 232 also has a cutout 245 in its opposite end from opening 228 through which bolt 240 projects when the bolt is in locked position, as will be explained, and has a keyhole 246 in its top surface for receiving a key (not illustrated) for operating the bolt. The frame and cover plate of the latch unit also have corresponding cutouts 247 in their sides for receiving bosses 248 of loop 222 to pivotally mount the loop on the latch unit. The frame and cover plate of the hasp unit 218 have similar cutouts 247' for receiving bosses 248' of loop 224 for mounting loop 224 on the hasp unit.

Plug spring 236 of the latch unit is preferably a generally U-shaped resilient member, as of spring steel, having a shape best illustrated in FIG. 9. An elongated slot or opening 250 is formed in each leg 251 of the plug spring adjacent to its open end, and the ends of each leg are curved inwardly to form cam surfaces 252 (the purposes of slots 250 and cam surfaces 252 will be explained shortly). The plug spring is adapted to be located on the raised portions in the bottom of frame 230 formed by the closing tab-receiving recesses 233, with the opening end of the plug spring facing opening 228. The sides of the plug spring may also have generally rectangular cutouts 254 which are located adjacent to corresponding rectangular cutouts 255 in the sides of frame 230 when the plug spring is in place on the frame. Another rectangular cutout 256 in the base of the plug spring is similarly adapted to be located adjacent to a corresponding cutout 257 in the end of the frame. The plug spring is held in position on the frame by spacer 238. As shown in FIG. 9, the spacer has a pair of rectangular tabs 260 which are sized to be received in cutouts 255 in the sides of the frame and the end 261 of the spacer is sized to be received in cutout 257 in the end of the frame (see FIG. 11) for supporting the spacer on the frame. The spacer, in cooperation with cutouts 254 and 256 in the plug spring, serves to properly locate the plug spring within the latch unit. As previously mentioned, the spacer also slideably supports the bolt 240 and, as will be described in detail hereinafter, cooperates with the bolt to provide a locking mechanism.

Plug spring 236 constitutes a resilient latching member having a latch portion for engaging hasp 226 to fasten the latch unit and the hasp unit together. The latch portion of the plug spring comprises slots 250 adjacent to the open end of the plug spring which receive correspondingly shaped inwardly facing projections 264 on the hasp (in the manner illustrated in FIGS. 11 and 12) when the hasp is inserted into opening 228 in the latch unit. The legs of the plug spring are normally biased apart (to latching position) so that when projections 264 are received in slots 250, the resilience of the plug spring tends to force the legs of the plug spring against the surfaces 266 of the hasp adjacent to projections 264 (assuming loop 222 is in its rest position, as will be explained shortly). This holds projections 264 and slots 250 in engagement, and prevents the hasp from moving out of opening 228. To unfasten the latch unit and the hasp unit, the ends of the plug spring must be moved toward each other (to non-latching position as illustrated in phantom lines in FIG. 11) to disengage projections 264 from slots 250.

As previously mentioned, the latching mechanism of latching assembly 200 is controlled by latch unit loop 222. When the loop is in the rest position, the latching mechanism is in a latching position. When the loop is in a slider-moving position (raised) the latching mechanism is in a non-latching position. However, in the first embodiment the latch portion of bolt spring 36 is normally biased to non-latching position and is disposed in latching position by loop 22 when the loop is in its rest position. In contrast, in the second embodiment the latch portion of plug spring 236 is normally biased to latching position and loop 222 disposes the latch portion in non-latching position when the loop is raised to its slider-moving position. The manner in which loop 222 controls the position of the latch portion of the plug spring will now be explained.

As shown in FIGS. 9 and 11, bosses 248 of loop 222 are generally cylindrical and comprise a long projection 270 and a short projection 271 separated by a slot 272. Between cutout 254 and slot 250, each leg 251 of the plug spring has an angled portion 274, as shown. When loop 222 is in its rest position, the end of each long projection 270 engages the adjacent side of the plug spring between slot 250 and angled portion 274, as shown in FIG. 11. The end of each short projection 271 is positioned and correspondingly angled to engage the adjacent angled portion 274, as also illustrated in FIG. 11. This allows the ends of the plug spring legs to assume their latching positions in which slots 250 engage projections 264 of the hasp. When loop 222 is lifted to the slider-moving position, the long projections 270 of the bosses rotate and engage the angled portions 274 to cam the ends of the plug spring legs toward each other to the non-latching position (shown in phantom lines in FIG. 11). As shown, this disengages slots 250 from projections 264 so that the latch unit and the hasp unit may be separated. Generally, loop 222 must be raised at least 45° from its rest position to move the legs of the plug spring together sufficiently to disengage the plug spring from the hasp.

As previously mentioned, loop springs 242, 242' bias the loops to their rest positions. The coiled portions 278, 278' of the loop springs are located on bosses 248, 248', respectively, with their ends received in slots 272, 272', and function in the same manner previously described for the first embodiment. When loop 222 is in its slider-moving position and is released, loop spring 242 returns the loop to its rest position. The ends of the plug spring, biased away from each other, are thus allowed to return to latching position, where they engage the sides of depressions 276 in clip 244 as shown in FIG. 11. The depressions serve as stops which prevent the ends of the plug spring from moving too far apart (which is possible if the legs should become bent during use) which could interfere with the operation of the latching mechanism.

Although loop 222 must be raised to the slider-moving position in order to unlatch the latch unit and the hasp unit, the latching mechanism of the assembly is such that the latch unit and the hasp unit may be latched together without moving loop 222 from its rest position. This feature is implemented in the following manner.

As best illustrated in FIG. 11, the leading portions 280 of the opposing faces of projections 264 of the hasp are angled outwardly and away from each other. The angled faces 280 constitute cam surfaces which cooperate with the curved ends 252 of the plug spring (which also constitute cam surfaces) to force the ends of the plug spring together (toward the non-latching position illustrated in phantom lines in FIG. 11) when the hasp is inserted into opening 228 of the latch unit. When the hasp has been inserted sufficiently to locate projections 264 adjacent to slots 250, the resiliency of the plug spring moves the ends back to latching position so that the projections enter the slots. Thus, the latch unit and the hasp unit may be fastened without moving loop 222 to the slider-moving position.

The loops are preferably die cast members. As in the first embodiment, latch unit loop 222 may be cast with a recess 282 on its underside which is adapted to receive bolt 240 when the bolt is in locking position to lock the loop in its rest position. As previously mentioned, the bolt is slideably supported within the latch unit by spacer 238. As shown in FIG. 9, the spacer has a side slip 284 and a slightly projecting portion 285 formed in end 261. As shown in FIGS. 11 and 12, the projecting portion 285 is adapted to be received in cutout 245 in the end of the latch unit cover plate and lip 284 serves as a guide for the forward end 286 of the bolt. The spacer is also formed with a pair of cam surfaces 288 and 289. Cam surface 288 is shaped to enter a notch 290 formed in the bolt, which provides a detent, when the bolt is in its non-locking position, as shown in FIG. 11. Bolt 240, which is preferably formed of heat treated aluminum, has a resilient arm 292 having a curved end 294 which engages cam surface 289 on the spacer, as also shown in FIG. 11. A second notch 296 is formed in the bolt adjacent to notch 290 and adapted to cooperate with a key (not illustrated) inserted into keyhole 246 for moving the bolt between locked and unlocked positions, in a manner similar to that described for the first embodiment. Spacer 238 may also have a key tang hole 298, as shown, for receiving the tang of a key inserted into the keyhole. A lip 299 formed on the end of the spacer adjacent to cam surfaces 288 and 289 limits the travel of the bolt to prevent it from being moved beyond the non-locking position into the latch unit (to the right in FIGS. 11 and 12).

The bolt is held in the non-locking position (the position illustrated in solid lines in FIG. 11) by the engagement between cam surface 288 and notch 290 and by the engagement of resilient arm 292 with cam surface 289. When the bolt is moved to locking position (to the left in FIGS. 11 and 12) the rounded end 294 of the resilient arm slides over cam surface 289 to allow notch 290 to move past cam surface 288 and so that side 300 of the bolt adjacent to notch 290 moves into engagement with the left side (in FIG. 11) of surface 288. The movement of the bolt toward locked position is limited by the engagement of the resilient arm with the interior surface of cover plate 232 adjacent to opening 245.

Clip 244 functions as a snap fastener, in a manner similar to that described for clip 40 of the first embodiment, to attach the latch unit to a lug 302 of the zipper slider (FIG. 12). The lug is received through an elongated opening 304 in the bottom of the frame. Clip 244 has a generally U-shaped central section formed by depending members 306 having curled under end portions 308, as best shown in FIG. 9. The depending members of the clip (which is preferably formed from spring steel) are adapted to be cammed outwardly by the slider lug when it is inserted into the latch unit and the curled under end portions are adapted to be positioned beneath the shoulders of the lug in the same manner as previously described for the first embodiment. Clip 244' of the hasp unit is preferably identical to clip 244 and functions in the same manner for attaching the hasp unit to its slider. As shown in FIGS. 11 and 12, clip 244 is adapted to be positioned on the top edges of the sides of frame 230, and to be positioned adjacent to the underside of the cover plate. One end of clip 244 has a rectangular projection 310 adjacent to depressions 276 which abuts the interior surface of the end wall of the cover plate adjacent to opening 228. The length of the clip is selected so that its opposite end 312 abuts the interior surface of the opposite end wall of the cover plate adjacent to a lip 314. Lip 314 supports loop 222 in its rest position (see FIG. 12). Clip 244' is similarly positioned in the hasp unit.

As shown in FIG. 9, the portion of clip 244 adjacent to end 312 has a large central opening 316 with depending tabs 318 located on the transverse sides of the opening. As best illustrated in FIGS. 11 and 12, opening 316 accommodates the depression 319 in the cover plate surrounding keyhole 246 and provides access to the bolt for a key. Depending tabs 318 engage the top of bolt 240 to maintain the bolt in contact with the spacer 238.

As shown in FIGS. 10–12, a rectangular projection 310' of clip 244' is adapted to be positioned in a notch 320 formed in the top of hasp 226, and the ends of depressions 276' in the edges of the clip adjacent to projections 310' are adapted to abut the back of the hasp (see FIG. 12). The block-shaped portion 322 (FIG. 10) of the hasp is sized to be received in grooves 324' formed at the end of frame 230' by inwardly projecting depressions 326' in the sides of the frame. Depressions 326' in the frame and 276' in the clip abut the backside of the block-shaped portion 322 of the hasp to prevent the hasp from being pushed into the hasp unit. A lip 328' at the end of frame 230' and the lip in the end of the cover plate adjacent to opening 228' abut the front side of the block-shaped portion 322 of the hasp, as shown in FIG. 12. The hasp is thus prevented from being pushed into the hasp unit or from being pulled therefrom. Hasp 226 may be either molded plastic or die cast metal.

From the foregoing, it can be appreciated that latching assembly 200 operates in the same manner as latching assembly 10 of the first embodiment. Latching assembly 200 may be employed with conventional zipper sliders, and loops 222 and 224 may be used as conventional slider pull tabs for moving the sliders along the zipper stringers. As previously described, the latching mechanism of latching assembly 200 is controlled by the position of loop 222 of the latch unit. To move the sliders apart when they are in latched position, loop 222 is moved to the slider-moving position to disengage the latch portions of the plug spring from the hasp. To fasten the sliders, the latch unit and the hasp unit are moved together so that the hasp is inserted into the latch unit. As pointed out above, it is unnecessary to operate loop 222 to latch the two units together. This is an advantage of latching assembly 200 over latching assembly 10. In other respects, the same advantages previously described for latching assembly 10 are obtained with latching assembly 200.

While the foregoing description has been with reference to particular illustrated embodiments of the invention, it will be appreciated that various changes and modifications may be made without departing from the principles and spirit of the invention, the scope of which is defined in the appended claims.

The invention claimed is:

1. A zipper slider latching assembly comprising a latch member, a latch unit adapted to be mounted on and attached to a zipper slider, the latch unit having means for receiving the latch member and having spring-biased latching means therein engageable with the latch member for fastening the latch member and the latch unit together, and slider pull means mounted on the latch unit for moving the slider and for controlling the latching means, the slider pull means having a rest position at which the latching means is in a latching position, and having a slider-moving position at which the latching means is in a non-latching position, wherein the latching means comprises a resilient member having a latch portion engageable with the latch member when the latching means is in the latching position, and wherein the latch portion is biased toward the non-latching position and the slider pull means includes means for disposing the latch portion in the latching position when the slider pull means is in the rest position.

2. The assembly of claim 1, wherein the latch portion is formed to enter a slot in the latch member.

3. The assembly of claim 1, wherein the latch portion has cam means adapted to be engaged by the latch member when the latch member enters the latch unit for disposing the latch portion in non-latching position, independently of the position of the slider pull means, to permit the latch member to be received in the latch unit.

4. The assembly of claim 1, wherein the disposing means includes cam means engageable with a cooperable cam surface on the resilient member.

5. A zipper slider latching assembly comprising a latch member, a latch unit adapted to be mounted on and attached to a zipper slider, the latch unit having means for receiving the latch member and having spring-biased latching means therein engageable with the latch member for fastening the latch member and the latch unit together, and slider pull means mounted on the latch unit for moving the slider and for controlling the latching means, the slider pull means having a rest position at which the latching means is in a latching position, and having a slider-moving position at which the latching means is in a non-latching position, locking means disposed within the latch unit, the locking means having a locking position in which it is engageable with the slider pull means to prevent movement of the slider pull means from said rest position, the locking means comprising a bolt slideably disposed within the latch unit, and the slider pull means including a recess adapted to be entered by the bolt when the slider pull means is in the rest position and the bolt is in the locking position, wherein the latching means comprises a resilient member having a bolt-spring portion operable to hold the bolt alternately in said locking position and a non-locking position.

6. The assembly of claim 5, wherein the resilient member comprises a leaf spring having a latch portion, the latch portion including an upturned end of said spring, and wherein the bolt-spring portion includes arcuate means for engaging a depression on the bolt.

7. The assembly of claim 6, wherein the leaf spring is generally H-shaped, having a pair of long legs and a pair of short legs extending from a central section, the long legs comprising said latch portion and the short legs comprising said bolt-spring portion, and the arcuate means comprises an arcuate section positioned between the central section and an end of each of the short legs.

8. The assembly of claim 5, wherein the bolt comprises a generally planar member having a resilient cam portion, and wherein the latch unit includes a support member for slideably supporting the bolt thereon, the support member being formed with a cam surface cooperable with the cam portion of the bolt for holding the bolt alternately in said locking position and a non-locking position.

9. A zipper slider latching assembly comprising a latch member, a latch unit adapted to be mounted on and attached to a zipper slider, the latch unit having means for receiving the latch member and having spring-biased latching means therein engageable with the latch member for fastening the latch member and the latch unit together, and slider pull means mounted on the latch unit for moving the slider and for controlling the latching means, the slider pull means having a rest position at which the latching means is in a latching position, and having a slider-moving position at which the latching means is in a non-latching position, the assembly further comprising means for biasing the slider pull means toward the rest position, wherein the slider pull means comprises a generally U-shaped loop having a pair of legs, each leg having an inwardly projecting boss for pivotally mounting the loop on the latch unit, and wherein at least one boss includes a slot, and said means for biasing the loop toward the rest position includes a spring having a portion received in the slot.

10. The assembly of claim 9, wherein the loop lies adjacent to the latch unit when the loop is in the rest position and is pivoted at an angle to the latch unit when in the slider-moving position.

11. The assembly of claim 9, wherein each boss includes cam means engageable with the latching means for controlling the position of the latching means in accordance with the position of the loop.

12. The assembly of claim 11, wherein the latching means comprises a resilient member having a latch portion, the latch portion being biased toward the non-latching position, and having an arcuate section cooperable with said cam means for disposing the latch portion in the latching position when the loop is in its rest position and for allowing the latch portion to move to the non-latching position when the loop is pivoted from its rest position.

13. The assembly of claim 11, wherein the latching means comprises a resilient member having a latch portion, the latch portion being biased toward the latching position, and having cam surface means cooperable with said cam means for disposing the latch portion in the non-latching position when the loop is in its slider-moving position and for allowing the latch portion to move to the latching position when the loop is in its rest position.

14. A zipper slider latching assembly comprising a latch member, a latch unit adapted to be mounted on and attached to a zipper slider, the latch unit having means for receiving the latch member and having spring-biased latching means therein engageable with the latch member for fastening the latch member and the latch unit together, and slider pull means mounted on the latch unit for moving the slider and for controlling the latching means, the slider pull means having a rest position at which the latching means is in a latching position, and having a slider-moving position at which the latching means is in a non-latching position, wherein the latch unit comprises fastener means for attaching said latch unit to a zipper slider, the assembly further comprising a hasp unit formed for attachment to another zipper slider, the latch member being part of the hasp unit, and the zipper sliders being related to zipper stringer means such that said units may be brought together in opposing relationship and such that the latch member may be engaged by the latching means.

15. A latching assembly comprising a spring member having a latch portion and a bolt-spring portion, the latch portion being movable between latching and non-latching positions and being adapted to engage associated latch means when in the latching position to latch thereto, actuating means movable between first and second positions and being engageable with the spring member for controlling the position of the latch portion, the latch portion being in the latching position when the actuating means is in the first position and being in the non-latching position when the actuating means is in the second position, and bolt means movable between a locking position and a non-locking position, the bolt-spring portion of the spring member being cooperable with the bolt means for alternately holding the bolt means in the locking and the non-locking positions, and the bolt means being engageable with the actuating means when in the locking position to prevent movement of the actuating means from the first position.

16. A latching assembly for a double-slider zipper arrangement comprising a latch unit formed for mounting on and attaching to a first zipper slider and for receiving a latch member, a hasp unit formed for mounting on and attaching to a second zipper slider, the latch member being part of the hasp unit and the first and second zipper sliders being related to zipper stringers such that the zipper sliders can be brought together in opposing relationship with the latch member received in the latch unit, resilient latching means disposed within the latch unit and having a latching position for latching to the latch member and having a non-latching position, and first and second slider pull means mounted on the latch unit and a hasp unit, respectively, for moving the sliders, each slider pull means having a rest position at which it is substantially flush with its corresponding unit and each having a slider-moving position at which it is pivoted from its rest position, the first slider pull means having means for controlling the position of the latching means such that the latching means is in the latching position when the first slider pull means is in the rest position and the latching means is in the non-latching position when the first slider pull means is in the slider-moving position.

17. The latching assembly of claim 16, wherein the latching means comprises a spring member having a latch portion, the latch portion being biased toward the non-latching position, and wherein the controlling means comprises cam means on the first slider pull means, the cam means being engageable with cooperable cam means on the spring member for disposing the latch portion in latching position when the first slider pull means is in the rest position.

18. The assembly of claim 16, wherein the latching means comprises a spring member having a latch portion, the latch portion being biased toward the latching position, and wherein the controlling means comprises cam means on the first slider pull means, the cam means being engageable with cooperable cam means on the spring member for disposing the latch portion in non-latching position when the first slider pull means is in the slider-moving position.

19. The assembly of claim 16, wherein the latch unit comprises means for locking the first slider pull means in the rest position, thereby locking the latching means in the latching position.

* * * * *